United States Patent [19]

Miyazawa

[11] Patent Number: 4,912,689

[45] Date of Patent: Mar. 27, 1990

[54] COMPENSATING CIRCUITRY FOR AN ELECTRONIC WATCH

[75] Inventor: Osamu Miyazawa, Nagano, Japan

[73] Assignee: Seiko Epson Corporation, Tokyo, Japan

[21] Appl. No.: 347,086

[22] Filed: May 4, 1989

[30] Foreign Application Priority Data

May 7, 1988 [JP] Japan ..... 63-111020

[51] Int. Cl.[4] ..... G04B 19/04; G04F 5/00

[52] U.S. Cl. ..... 368/80; 368/160

[58] Field of Search ..... 368/76, 80, 124–127, 368/157, 160–163, 168, 184

[56] References Cited

U.S. PATENT DOCUMENTS 3,952,497 4/1976 Schulz et al. ..... 368/163
3,978,654 9/1976 Kolke et al. ..... 368/80

FOREIGN PATENT DOCUMENTS 54-75520 6/1979 Japan .
54-77162 6/1979 Japan .
55-87977 3/1980 Japan .
56-47512 11/1981 Japan .

*Primary Examiner*—Vit W. Miska
*Attorney, Agent, or Firm*—Blum Kaplan

[57] ABSTRACT

A timepiece includes a hairspring for storing the energy provided by a step motor driving circuit and a rotor immersed in a viscous fluid controls the energy released by the hairspring to provide a constant driving force for turning the display hands of the timepiece. Compensating circuitry varies the strength of a driving signal supplied to the step motor to minimize the adverse influence of variations in the load torque due to changes in ambient temperature and/or additional loads associated with a calendar mechanism.

31 Claims, 11 Drawing Sheets

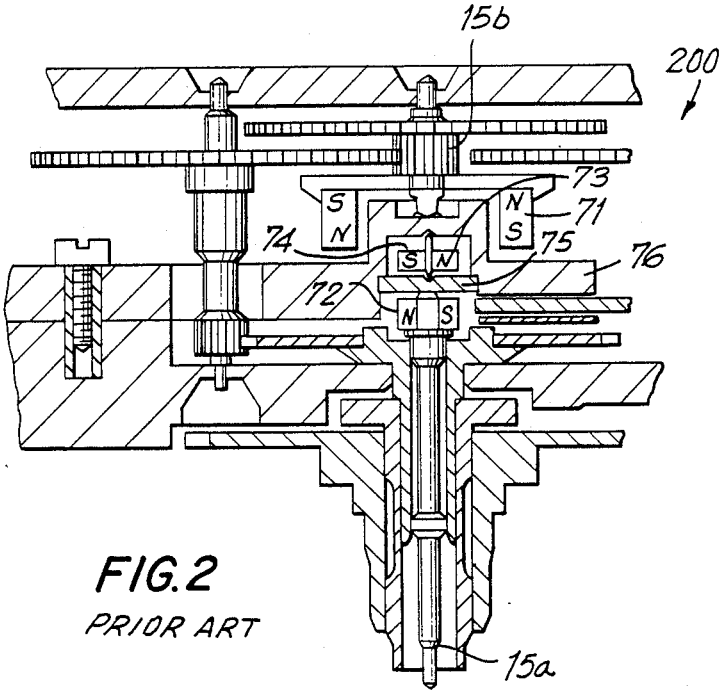
FIG. 2
PRIOR ART
FIG. 4
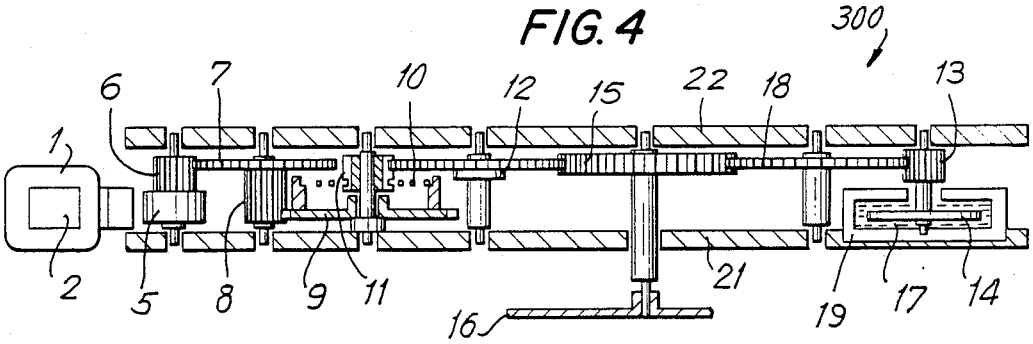

| CORRECTIVE STATE | | $v_1$ | $v_2$ | $v_3$ |
|---|---|---|---|---|
| (a) | COMPARATIVE VOLTAGE | 1.58 | 1.1 | 0.6 |
| (b) | CORRECTION QUANTITIES (CORRES. TO SECOND) | 1.2 | 1.6 | 1.8 |

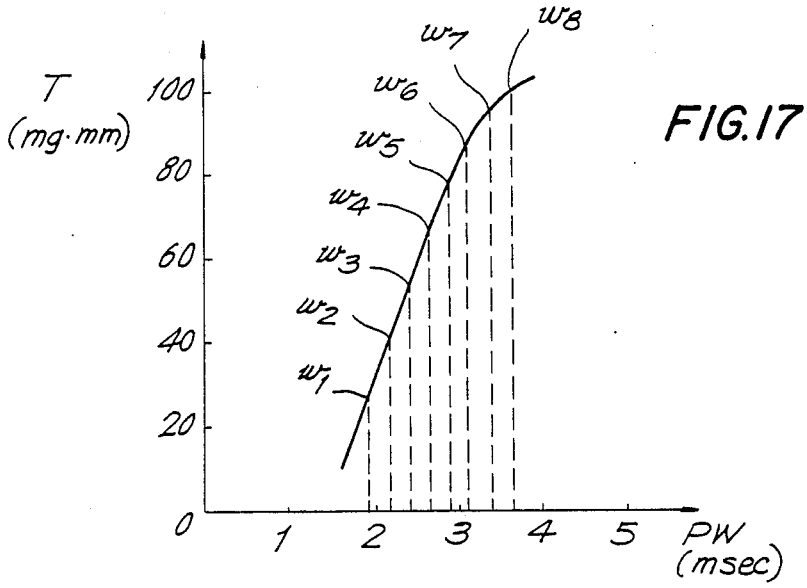
FIG.17
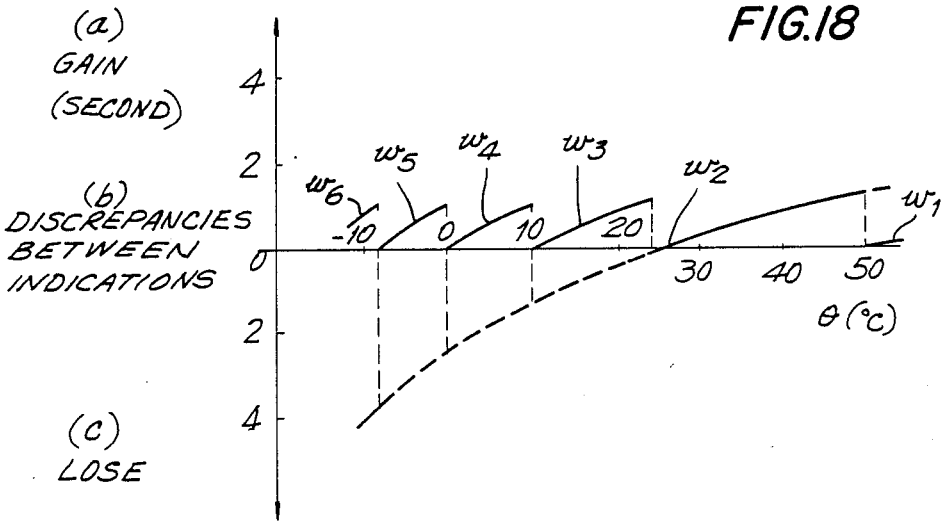
FIG.18
FIG.19
| | $w_1$ | $w_2$ | $w_3$ | $w_4$ | $w_5$ | $w_6$ | $w_7$ | $w_8$ |
|---|---|---|---|---|---|---|---|---|
| DRIVING PULSE WIDTH (msec) | 1.95 | 2.20 | 2.44 | 2.69 | 2.93 | 3.17 | 3.42 | 3.66 |
| $\alpha$ | 0 | 1 | 0 | 1 | 0 | 1 | 0 | 1 |
| $\beta$ | 0 | 0 | 1 | 1 | 0 | 0 | 1 | 1 |
| $\Gamma$ | 0 | 0 | 0 | 0 | 1 | 1 | 1 | 1 |
| CORRECTION QUANTITIES (CORRES. TO SECOND) | 1.2 | 1.1 | 1.1 | 1.0 | 1.0 | 0.9 | 0.8 | |

COMPENSATING CIRCUITRY FOR AN ELECTRONIC WATCH

BACKGROUND OF THE INVENTION

This invention relates to a timepiece, and more particularly to compensating for delays and advances in the hand movement of an analog electronic watch.

A conventional electronic watch 200 which is disclosed in Japanese Patent Publication No. 47512/1981, is illustrated in FIG. 2. Watch 200 is driven by a quartz oscillator. Intermittent rotational energy is accumulated through magnetic attraction between a driving magnet 71 and a driven magnet 73. Driving magnet 71 is coupled to a fourth pinion 15*b*. Driven magnet 73 is immersed in a viscous fluid 74; both of which are contained in a housing 76. Rotation of driven magnet 73 in viscous fluid 74 transforms the intermittent rotational movement of driving magnet 71 into a relatively constant, uninterrupted rotational force. Driven magnet 73 magnetically interlocks with a follower magnet 72. A relatively constant, smooth rotation of a hand spindle 15*a*, which is coupled to follower magnet 72, results. A cap 75 serves to seal viscous fluid 74 within receiver 76. The driving circuitry for watch 200 is based on a low power consuming type driving system such as disclosed in Japanese Patent Laid-Open Nos. 75520/1979, 77162/1979 and 87977/1980.

The degree of angular deviation between driving magnet 71 and driven magnet 73 varies based on the viscosity of viscous fluid 74. More particularly, as the temperature varies, the viscosity of viscous fluid 74 changes resulting in hand spindle 15*a* rotating either too quickly or too slowly. Discrepancies in the time displayed by watch 200 results. Alternatively, the increase in load associated with a calendar wheel train can cause the angular deviation between driving magnet 71 and driven magnet 73 to vary resulting in discrepancies in the time displayed by watch 200. The accuracy in time displayed by watch 200 is decreased.

Accordingly, it is desirable to provide a timepiece having hand sweep-driven movement in which accurate time is displayed. The accuracy in the displayed time should be maintained regardless of changes in ambient temperature or in load associated with a calendar mechanism.

SUMMARY OF THE INVENTION

Generally speaking, in accordance with the invention, a timepiece includes an oscillator for producing a first oscillating signal and a frequency divider circuit for counting the frequency of the first oscillating signal and for producing a second oscillating signal having a frequency which is less than the frequency of the first oscillating signal. The second oscillating signal is supplied to a motor driving circuit which produces a driving signal. A rotor of a step motor produces a mechanical driving force based on the driving signal. A hairspring stores energy associated with the mechanical driving force and produces a driving torque based on the stored energy. A rotor immersed in a viscous fluid to which the driving force is applied through a grear train creates a load torque. The rotor immersed in the viscous fluid serves as a control mechanism for maintaining the driving torque at a relatively constant level. The hands of the timepiece rotate based on the driving torque.

The timepiece also includes compensating circuitry for varying the strength of the driving signal based on the level of the load torque. Corrective advancement or delay in the time displayed in accordance with the change in viscosity of the viscous fluid is achieved. The timepiece maintains an accurate displayed time even though subjected to variations in ambient temperature.

The compensating circuitry increases or decreases the strength of the driving signal by varying the frequency and/or pulse duration of the driving signal based on an inverse induced current flowing through a coil of the step motor. More particularly, detecting circuitry monitors inverse induced voltages corresponding to the inverse induced current flowing through the coil of the step motor. The inverse induced current corresponds to the present level of the load torque.

The compensating circuitry also includes control circuitry which produces control signals supplied to the oscillator and frequency divider circuit. The frequency of the first oscillating signal produced by the oscillator and the frequency and timing of the second oscillating signal produced by the frequency divider circuit vary based on the control signals. Additional control signals supplied to the motor driving circuit affect the duration of the driving signal.

Accordingly, it is an object of the invention to provide an improved timepiece which provides an accurate display of time.

It is another object of the invention to provide an improved timepiece which provides an accurate display of time when subjected to variations in ambient temperature.

It is a further object of the invention to provide an improved timepiece which increases or decreases the strength of the driving signals supplied to the step motor of the timepiece based on variations in load torque of the timepiece.

Still other objects and advantages of the invention will in part be obvious and will in part be apparent from the specification.

The invention accordingly comprises several steps in a relation of one or more such steps with respect to each of the others, and the apparatus embodying features of construction, a combination of elements and arrangements of parts which are adapted to effect such steps, all as exemplified in the following detailed disclosure and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a fragmented sectional view of a prior art electronic watch;

FIG. 4 is a fragmented sectional view of a wheel train unit of FIG. 3;

FIG. 17 is a plot of the torque provided by the step motor versus pulse widths of the driving pulses supplied to the step motor;

FIG. 18 is a plot of displayed time versus temperature associated with FIG. 17; and FIG. 19 is a correction table associated with FIG. 17 and 18.

DETAILED DESCRIPTION OF THE PREFERRED EMBODIMENTS

Figure 3:
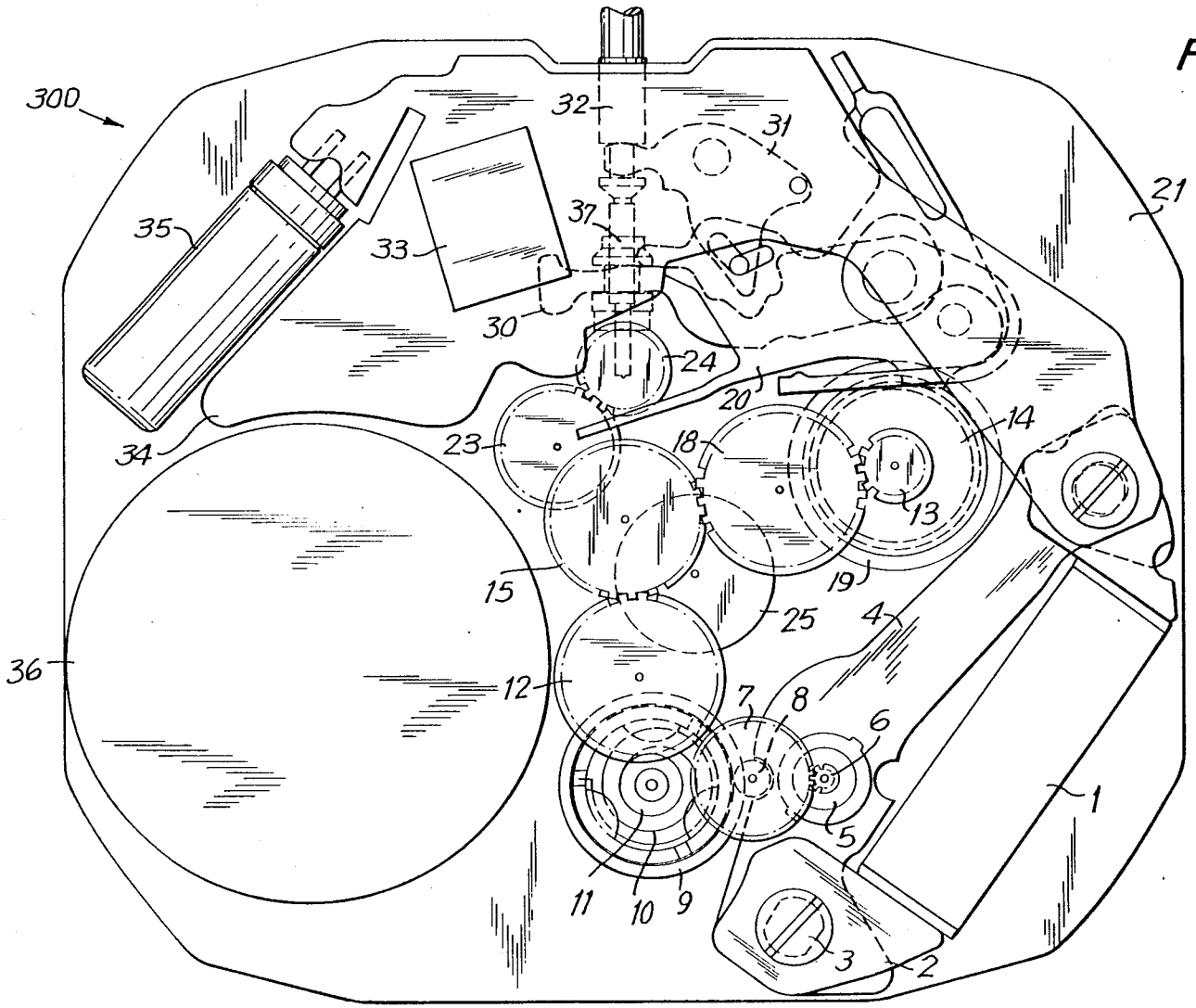
FIG. 3 is a plan view of a timepiece in accordance with the invention.

As shown in FIGS. 3 and 4, an electronic watch 300 includes a step motor (i.e. an actuator) which includes a stator 4, a magnetic core 2, a rotor 5 and a coil 1. A hairspring 10, which serves as the accumulator for rotational energy produced by the step motor, stores the rotational energy based on its elastic deformation. A control mechanism includes a viscous rotor 14 which is immersed in a viscous fluid 17 and which produces a load torque applied to the wheel train mechanism.

Coil 1 of the step motor generates a magnetic field for driving rotor 5 through magnetic core 2 and stator 4. A screw 3 fixes coil 1 to the body of timepiece 300. Rotor 5 is coupled to a hair wheel 9 through a sixth pinion 6, a fifth gear 7 and a fifth pinion 8. Rotation of rotor 5 drives hair wheel 9. Hairspring 10 is connected to hair wheel 9 and hairspring pinion 11. As hair wheel 9 intermittently rotates, an angular deviation between hair wheel 9 and hairspring pinion 11 is created due to the elastic deformation of hairspring 10. As hairspring 10 begins to recoil, producing a recoil torque, hairspring pinion 11 begins to rotate. A second hand 16 is coupled to hairspring pinion 11 through a fourth idler 12 and a fourth wheel 15. Rotation of hairspring pinion 11 causes second hand 16 to rotate. Viscous rotor 14 is coupled to fourth wheel 15 through a viscous rotor idler 18 and a rotor shaft 13.

As viscous rotor 14 rotates, a load torque proportional to the angular velocity of viscous rotor 14 is produced based on the viscous friction between viscous rotor 14 and viscous fluid 17. The load torque serves to regulate (i.e. control) any change in the rate of speed at which second hand 16 rotates. More particularly, as the recoil torque stored in hairspring 10 increases based on the difference in rotational frequency between hair wheel 9 and hairspring pinion 11, the rotational frequency of hairspring pinion 11 increases until it reaches a constant speed of rotation. Since the load torque of viscous rotor 14 changes in proportion to its angular velocity, the recoil torque retained by hairspring 10 as it increases results in increasing the angular velocity of viscous rotor 14. An increase in the viscous load of viscous rotor 14 results which opposes any increase in the angular velocity of viscous rotor 14. Since viscous rotor 14 is coupled through the gear train to hairspring pinion 11, any increase in the angular velocity of hairspring pinion 11 is also opposed. Similarly, when the torque retained in hairspring 10 decreases, any decrease in the angular velocity of hairspring pinion 11 is opposed by the viscous load of viscous rotor 14. Consequently, the speed at which second hand 16 rotates is maintained at a substantially constant level.

Interposition of viscous rotor idler 18 permits variations in the layout of the gear train mechanism. Adjustments to the hour hand and minute hand (not shown) are made by operating a winding stem 32, which when pulled out causes a second setting lever 20 to readjust the position of one of the wheels of the wheel gear train and to substantially simultaneously come into contact with a reset part of a circuit board 34. The positioning of second setting lever 20 is based on a setting lever 31 engaging a groove of winding stem 32. The center of a clutch wheel 37 has a substantially square opening and is slidable in a longitudinal direction along a square shaft of winding stem 32. As winding stem 32 rotates, clutch wheel 37 engages the square shaft of winding stem 32 and thereby rotates in the same direction as winding stem 32. A yoke 30 is subjected to a clockwise turning force by a spring (not shown). Yoke 30 engages a groove of clutch wheel 37 to position clutch wheel 37 so as to mesh with a small iron wheel 24. Wheel 24 is coupled to fourth wheel 15 through a date rear wheel 23. Date rear wheel 23 serves to drive the hour hand. Accordingly, the sliding action of clutch wheel 301 meshing with small iron wheel 24 by action of a gate bar (not shown) and setting lever 31 permits the hour and minute hands to be adjusted.

A third wheel 25 serves to decelerate the rotary movement of fourth wheel 15 and drives the minute hand. An integrated circuit (I.C.) 33 includes the compensating circuitry in accordance with the invention. The frequency of the driving waveforms supplied by coil 1 for actuating rotor 5 of the step motor are based on the oscillating signal produced by a quartz oscillator 35. A battery 36 powers timepiece 300. Viscous rotor 14 and viscous fluid 17 are disposed in a container 19.

Figure 5:
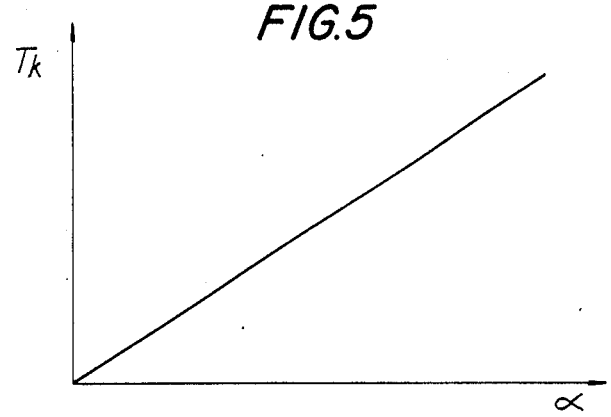
FIG. 5 is a plot of recoil torque versus winding angle of a hairspring.

As shown in FIG. 5, a substantially linear relationship exists between recoil torque $T_k$ and a winding angle $\alpha$ of hairspring 10. A suitable value of a spring constant K of hairspring 10 is approximately 0.4 mg.mm/deg resulting in a rotation of hairspring pinion 11 of about 3 rpm.

Figure 6:
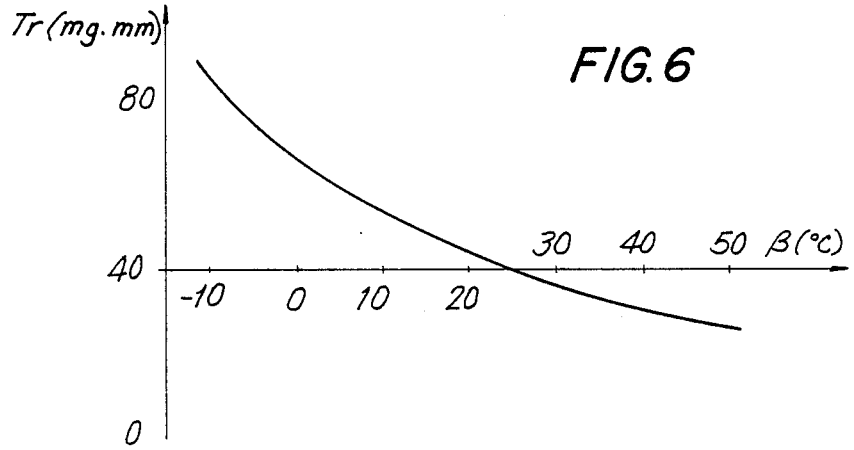
FIG. 6 is a plot of load torque versus temperature of a control mechanism.

FIG. 6 illustrates the relationship between a load torque $T_r$ and a temperature $\beta$ of viscous rotor 14. The rotational frequency of viscous rotor 14 is approximately 2 rpm. The scaled values shown on the axes for load torque $T_r$ and temperature $\beta$ are based on the rotational frequency of approximately 2 rpm. Load torques $T_r$ of about 40 mg.mm, 85 mg.mm and 25 mg.mm are produced at temperatures $\beta$ of about 25° C., −10° C. and 50° C., respectively.

When the step motor is driven with regularity, winding angle $\alpha$ is proportional to load torque $T_r$. At a temperature of about 25° C., winding angle $\alpha$ is about 67°.

When temperature $\beta$ is $-10°$ C., the proportional relationship changes and produces winding angle $\alpha$ of about 140°. The difference of approximately 73° in winding angle $\alpha$ produces a delay of about 4 seconds in the time which is displayed by timepiece 300 at $-10°$ C. as compared to the time displayed at a temperature of about 25° C. At a temperature of about 50° C., timepiece 300 displays a time which is approximately 1.4 seconds faster than the time displayed at a temperature of 25° C.

Figure 7:
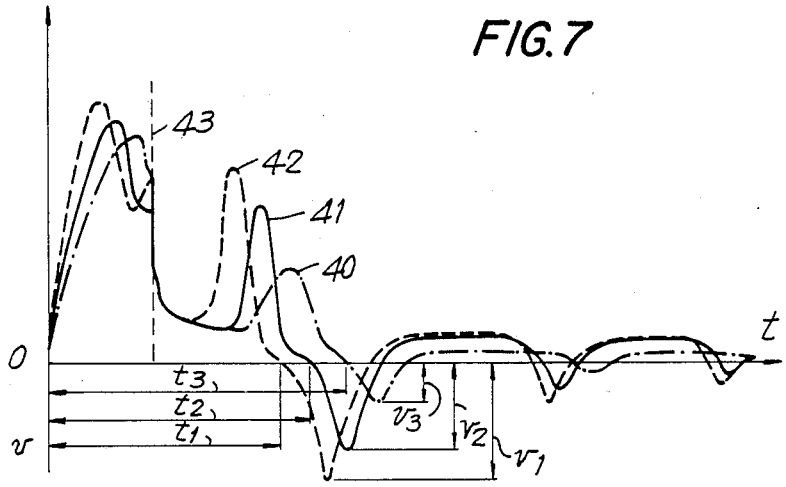
FIG. 7 is a plot of induced voltages at various temperatures across a step motor of FIG. 3.

FIG. 7 illustrates the induced voltage (or current) waveforms across rotor 5 based on the current flowing through coil 1 of the step motor. Waveforms 40, 41 and 42 represent the induced voltages at temperatures of approximately 0° C., 20° C. and 40° C., respectively. Waveforms 40, 41 and 42 graphically illustrate a plot of induced voltage v versus time t. As the temperature increases, load torque $T_r$ is reduced. The inverse induced voltage level (i.e. values of induced voltage v below 0 volts) after completing application of a driving pulse also increases as the temperature increases. A terminating point 43 represents completion of a driving pulse application. Driving waveforms 40, 41 and 42 reach an induced voltage level of 0 volts at times $t_1$, $t_2$ and $t_3$. As the temperature increases, time t required for each driving waveform to reach its 0 voltage level decreases. In other words, as the temperature increases, the induced voltage approaches its 0 voltage level more rapidly. Variations in load torque $T_r$ are reflected in the level and periodic components of the inverse induced voltage. By monitoring the inverse induced voltage waveforms, changes in load torque $T_r$ can be recognized. Once recognition of a variation in load torque $T_r$ has been made, compensation of the displayed time of timepiece 300 is undertaken to correct for delays or advances in the hand movement.

Figure 1:
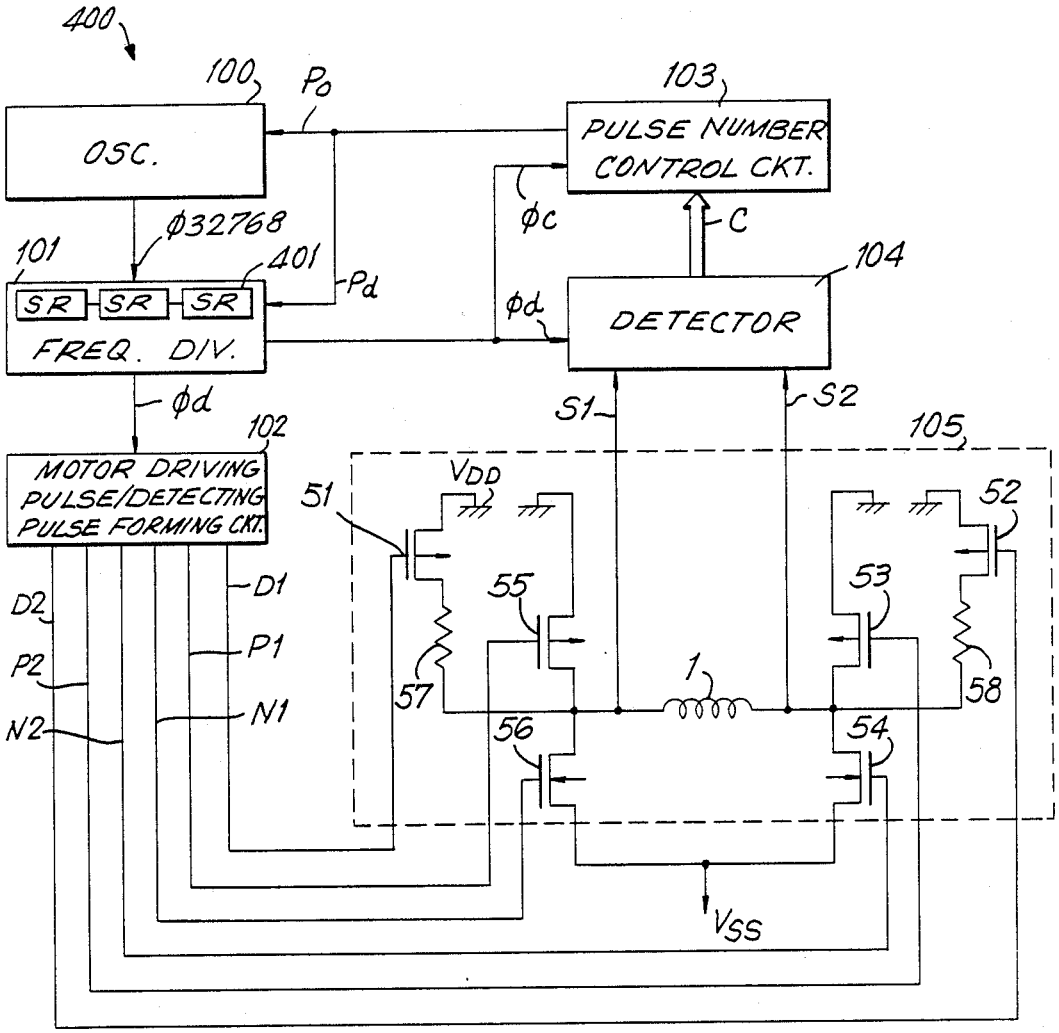
FIG. 1 is a schematic and block diagram of a compensating circuit in accordance with one embodiment of the invention.

A compensating circuit 400 for detecting the inverse induced voltage level and for connecting the displayed time is shown in FIG. 1. A timing circuit of compensating circuit 400 includes an oscillation circuit 100, a frequency dividing circuit 101, a motor driving pulse/-detecting pulse forming circuit 102 and a motor driver/-detecting voltage generation circuit 105. Oscillation circuit 100 generates standard signals $\phi$ 32768 having a frequency of 32768 Hz. A quarts oscillator serves as the source of oscillation for oscillation circuit 100. Frequency dividing circuit 101 sequentially divides through a plurality of ½ dividers 401 the frequencies of standard signals $\phi$ 32768 to produce an output signal $\phi_d$. Motor driving pulse/detecting pulse forming circuit 102 produces a pair of driving pulses P1, P2; inverted waveforms N1, N2 and detecting pulses D1, D2 based on output signal $\phi_d$. Waveforms N1 and N2 are inverted waveforms of driving pulses P1 and P2.

Motor driver/detecting voltage generation circuit 105 includes four P-channel MOSFETS 51, 52, 53 and 55 and two N-channel MOSFETS 54 and 56. Coil 1 of circuit 105 is supplied with alternating current by simultaneously turning ON MOSFETS 53 and 56 or MOSFETS 54 and 55. Rotation of rotor 5 results. The inverse induced current generated in coil 1 flows through a detecting resistor 57 and a detecting resistor 58 to a reference voltage level (e.g. ground) by turning on a pair of P-channel MOSFETS 51 and 52. Detecting pulses D1 and D2 control when MOSFETS 51 and 52 are turned ON, respectively. By selectively providing detecting pulses D1 and D2 to MOSFETS 51 and 52, a chopping process of the inverse induced currents is created. The inverse induced current flowing through coil 1 is determined based on the voltage levels of a pair of inverse induced voltages S1 and S2 (i.e. the voltage levels on either side of coil 1 when MOSFETS 51 and 52 are turned ON).

Detecting circuit 104 detects the load condition of the step motor based on inverse voltages S1 and S2 and produces detecting signals C which are supplied to pulse number control circuit 103. A pair of control signals $P_0$ and $P_d$ produced by pulse number control circuit 103 and based on detecting signals C are supplied to oscillator 100 and frequency divider 101, respectively. Based on control signal $P_0$, the frequency of the oscillating signal produced by oscillator 100 can be increased or decreased. Similarly, based on control signal $P_d$, the frequency and timing of output signal $\phi_d$ can be increased or decreased. Accordingly, the frequency of driving pulses P1 and P2 can be increased or decreased so as to increase or decrease the speed at which a sweep hand, second hand and minute hand of timepiece 300 rotate. A pair of watch signals $\phi_c$ and $\phi_d$ are supplied to pulse number control circuit 103 and detector 104 from frequency divider 101, respectively. Watch signals $\phi_d$ and $\phi_d$ serve as clock signals for controlling the operations of detecting circuit 104 and pulse number control circuit 103, respectively.

Figure 8:
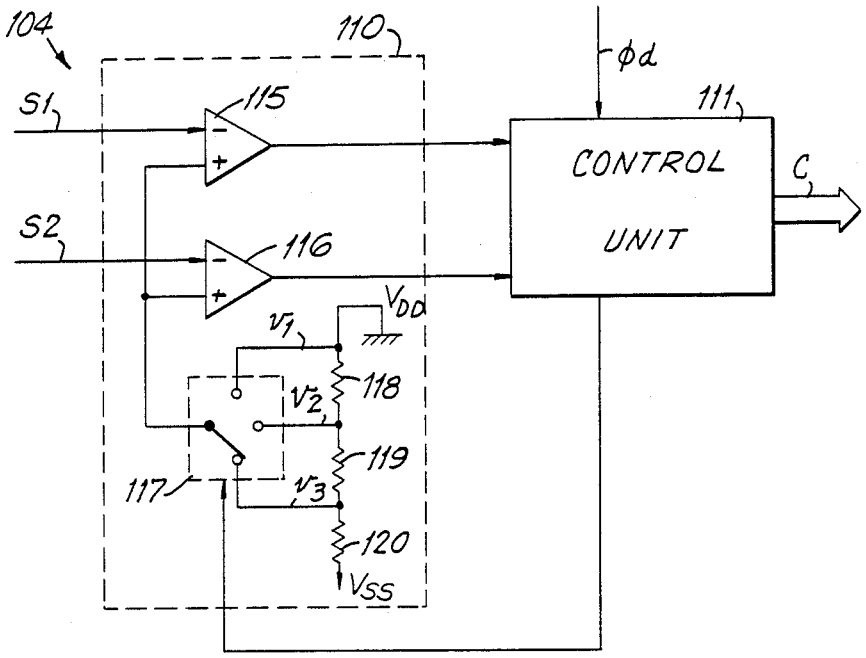
FIG. 8 is a schematic and block diagram of a detector of FIG. 1.

As shown in FIG. 8, detecting circuit 104, which includes a detecting unit 110 and a control unit 111, converts the analog signals of inverse induced voltages S1 and S2 into corresponding digital values represented by detecting signals C. Detecting unit 110 includes a pair of comparators 115 and 116 which receive inverse induced voltages S1 and S2 at their inverting inputs, respectively. Detecting unit 110 also includes three resistors 118, 119 and 120 which form a voltage divider circuit, dividing the voltage potential between a power source voltage $V_{DD}$ and a voltage source $V_{SS}$. The voltage between resistors 120 and 119 and between resistors 119 and 118 are represented by reference voltages $v_3$ and $v_2$, respectively. A reference voltage $v_1$ represents the voltage of source $V_{DD}$.

A switch 117 selects either reference voltages $v_3$, $v_2$ or $v_1$ based on an output signal produced by control unit 111. The selected reference voltage is applied to the non-inverting inputs of comparators 115 and 116. Watch signal $\phi_d$ controls the operation of control unit 111.

Comparators 115 and 116 compare inverse induced voltages S1 and S2 with the reference voltage selected. Although detector 4 as illustrated in FIG. 8 employs three reference voltages $v_1$, $v_2$ and $v_3$, it is to be understood that more or less reference voltages can be employed in accordance with the invention. The detection of inverse induced voltages monitors not only the voltage levels but also the timings at which inverse induced voltages S1 and S2 occur. The detection method may be changed provided that the inverse induced voltages reflect variations in load torque $T_r$.

Figure 9:
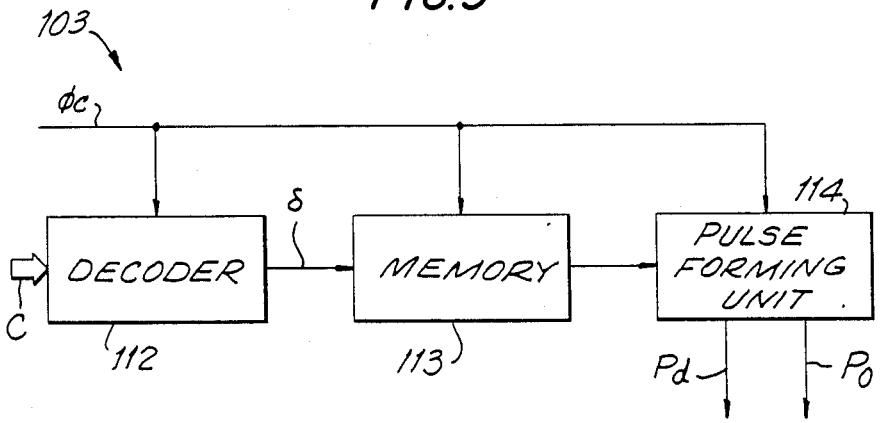
FIG. 9 is a block diagram of a pulse number control circuit of FIG. 1.

As shown in FIG. 9, pulse number control circuit 103 includes a decoder 112, a memory 113 and a pulse forming unit 114 which produces control signals $P_0$ and $P_d$. Decoder 112 produces a correction quantity signal $\delta$ based on decoding the magnitude and delay in second hand movement represented by detecting signal C. Memory 113 temporarily stores correction quantity signals $\delta$ so that the number of pulses supplied to the step motor for driving the latter is gradually increased or decreased as required. Accordingly, a user is unaware of when the displayed time is being corrected.

Decoder 112 also serves to prevent malfunctions caused by instantaneous fluctuations in the load due to impulses. Memory 113 provides only the stored correction quantity to pulse forming unit 114 when the load reverts to its original state. By varying the number of pulses as well as the pulse width of driving pulses P1 and P2 the speed at which the hands rotate can be increased or decreased to compensate for discrepancies in the displayed time.

Watch signals $\phi_c$ and $\phi_d$ are clock signals. Watch signal $\phi_c$ serves as the clock signal for decoder 112, memory 113 and pulse forming unit 114. Clock signal $\phi_c$ determines when control signals $P_d$ and $P_0$ are generated and the number of pulses and formation of the pulse width of each of these control signals. Detection of a high load state at low temperatures and a low load state at high temperatures is possible. Correction quantity $\delta$ stored in memory 113 is increased or decreased based on load torque $T_r$ and the time required to compensate for the discrepancy.

Figure 10:
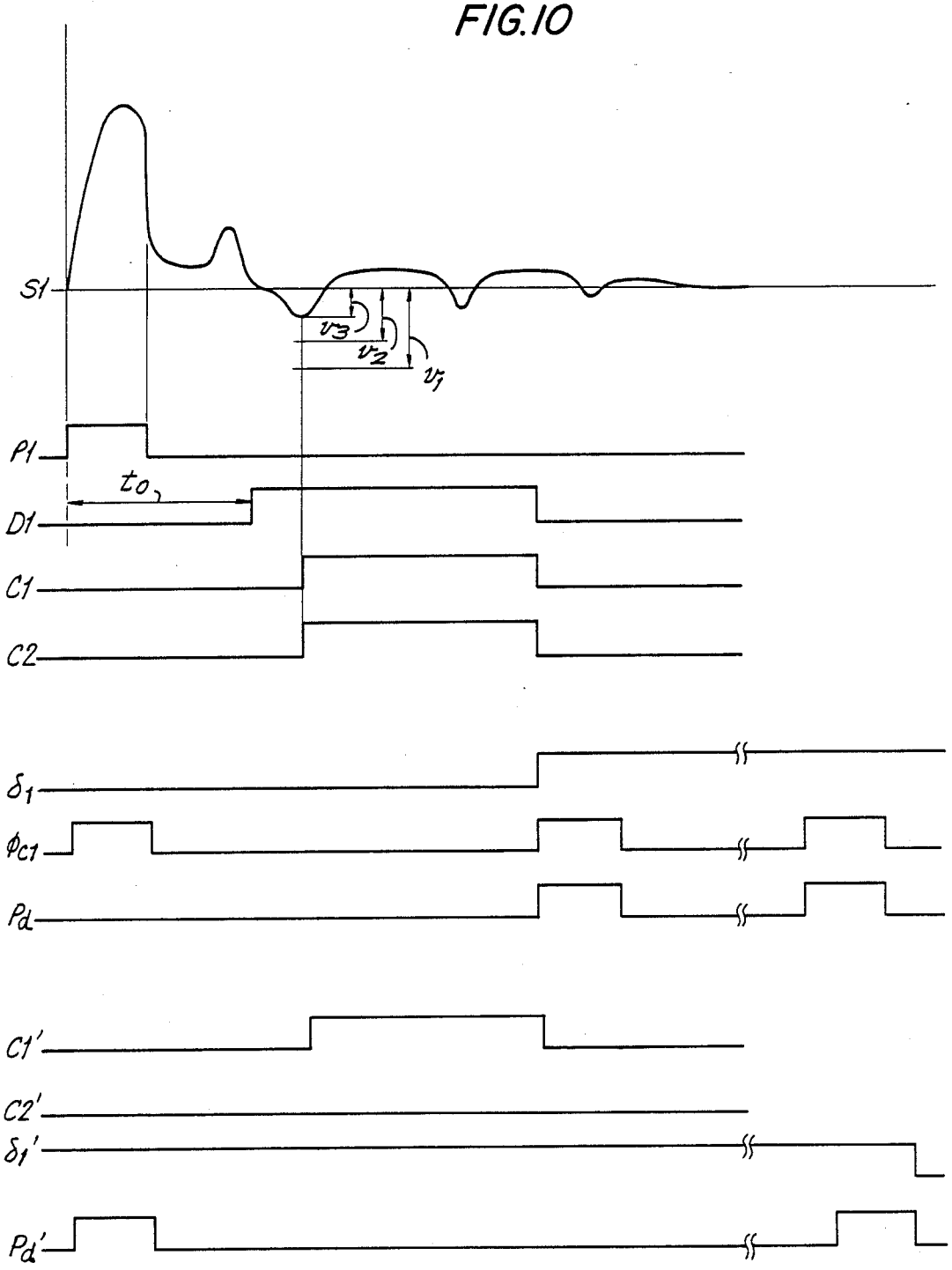
FIG. 10 is a timing chart illustrating various signals produced by the compensating circuit including signals produced by the detector and pulse number control circuit.

FIG. 10 illustrates the time relationship between the signals produced by motor driving pulse/detecting pulse forming circuit 102, motor driver/detecting voltage generation circuit 105, detector 104 and pulse number control circuit 103. In FIG. 10, inverse induced voltage S1 represents the inverse induced voltage based on a decrease in temperature. Detecting pulse D1 is not turned ON (masked) for a period of time $t_0$ which is less than the time $t_1$ of FIG. 7. This masking period prevents erroneous detection of load torque $T_r$. Detecting signals C include signals C1 and C2. Control unit 111 supplies signals C1 and C2 to detecting circuit 104 as a 2-bit expression since only three reference voltages ($v_1$, $v_2$ and $v_3$) are used by detecting unit 110. Driving pulse P1 turns ON MOSFET 55. Detecting pulse D1 turns ON P-channel MOSFET 51 so that inverse induced voltage S1 can be detected.

When detecting signals C exceed reference voltage $v_3$, signals C1 and C2 are at a high logic level. Signal C1 is at a high logic level and signal C2 is at a low logic level when the inverse induced voltage v is in excess of reference voltage $v_2$. Signals C1 and C2 are at low logic levels when the inverse induced voltage v is greater than reference voltage $v_1$. A correction quantity $\delta_1$ represents the correction to be inputted from memory 113 to pulse forming unit 114. Watch signal $\phi_{c1}$ represents the clock signal supplied to decoder 112, memory 113 and pulse forming unit 114 for controlling the timing at which control signals $P_d$ and $P_0$ are transmitted. Control signal $P_d$ based on the correction quantity desired can cause the step motor to advance by 6 steps/second rather than 4 steps/second. When an advancement representing a correction quantity of 1.5 seconds is desired, the step motor is driven at a cycle of 4 steps/second.

Detecting signals C1′ and C2′ represent detecting signals associated with the temperature reverting to its original state. Control signals $P_d'$ provided to frequency divider 101 reduce the number of driving pulses provided to the step motor and are produced until correction quantity $\delta'$ stored within memory 113 reverts to its original value prior to the temperature decrease. Control signals $P_d'$ result in a delay of the step motor of 6 steps/second.

Figure 11:
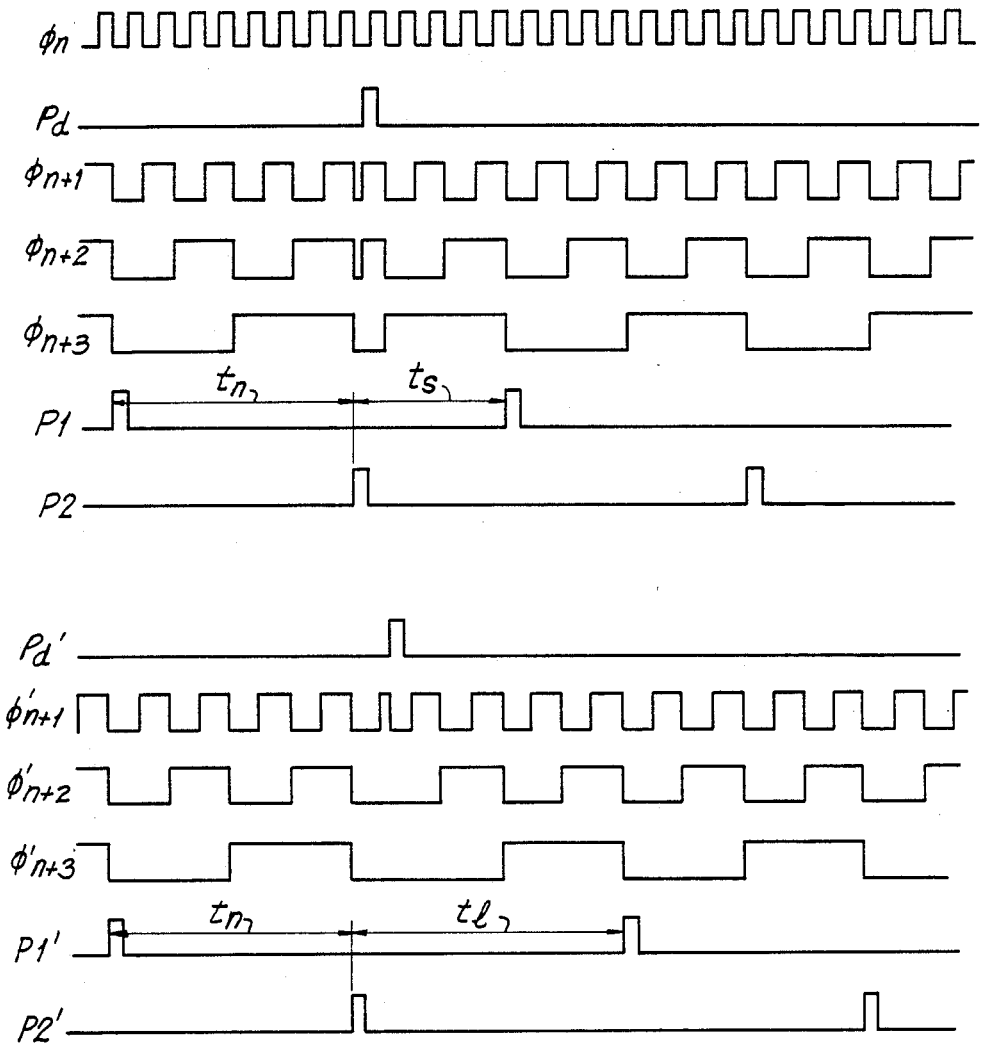
FIG. 11 is a timing chart of various signals for increasing and decreasing the speed at which the step motor is driven.

FIG. 11 illustrates the time relationship between the occurrence of control signal $P_d$ or $P_d'$ and the signals produced by frequency divider 101 and driving pulses P1 and P2 for increasing and decreasing the number of driving pulses P1, P2 produced by motor driving pulse/detecting pulse forming circuit 102. An oscillating signal $\phi_n$ is provided to frequency divider 101 by oscillator 100. Based on the number of stages ($\frac{1}{2}$ dividers) within frequency divider 101, the frequency of oscillating signal $\phi_n$ is reduced until a desired frequency is reached. FIG. 11 illustrates the outputs of three set/reset $\frac{1}{2}$ frequency dividers forming frequency divider 101. The first divider receives oscillating signal $\phi_n$ and produces signal $\phi_{n+1}$. The second divider produces signal $\phi_{n+3}$ based on signal $\phi_{n+2}$. The number of dividers in frequency dividing circuit 101 can be increased as desired. When control signal $P_d$ is supplied to frequency divider 101, the dividers which produce signals $\phi_{n+1}$ and $\phi_{n+2}$ are set at a high logic level. Since the dividers are connected sequentially, driving pulses P1 and P2 can be made to occur more frequently. More particularly, driving pulses P1 and P2 are alternately produced based on the occurrence of consecutive trailing edges of consecutive signal $\phi_{n+3}$. Prior to control signal $P_d$ being supplied to frequency divider 101, the trailing edges of signal $\phi_{n+3}$ occurred in time $t_n$. Once control signal $P_d$ is received by frequency divider 101, however, the time interval between consecutive trailing edges of signal $\phi_{n+3}$ is reduced to a time $t_s$ wherein time $t_s$ is less than time $t_n$. The foregoing setting of certain dividers of frequency divider 101 are repeated until the step motor has increased the speed at which the hands of timepiece 300 rotate so as to compensate for the increase in load torque $T_r$ due to a decrease in temperature.

Conversely, when control signal $P_d'$ is supplied to frequency divider 101, the dividers which produce signals $\phi_{n+1}$ and $\phi_{n+2}$ are reset resulting in the production of driving pulses P1′ and P2′ at a slower rate. More particularly, the consecutive trailing edges of signal $\phi_{n+3}$ occur in time $T_l$ which is greater than time $t_n$.

Figure 12:
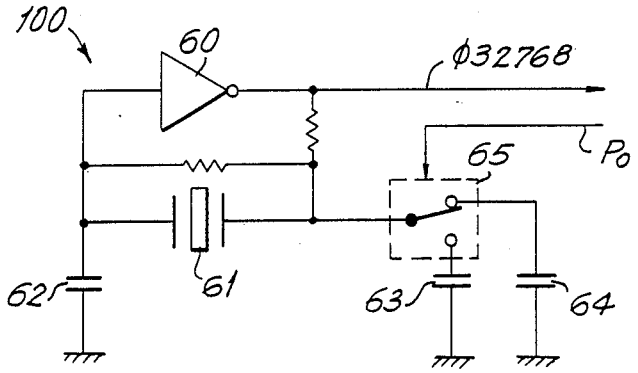
FIG. 12 is a schematic diagram of the oscillator of FIG. 1.

As shown in FIG. 12, oscillation circuit 100 includes a quartz oscillator 61 which produces an oscillating signal which is applied to an inverter 60. Oscillation circuit 100 also includes a gate side capacitor 62 and two drain side capacitors 63 and 64 which provide slight adjustments to the oscillation frequencies produced by oscillation circuit 100. A switch 65 connects either drain side capacitor 63 or drain side capacitor 64 to quartz oscillator 61 based on control signal $P_0$.

Figure 13:
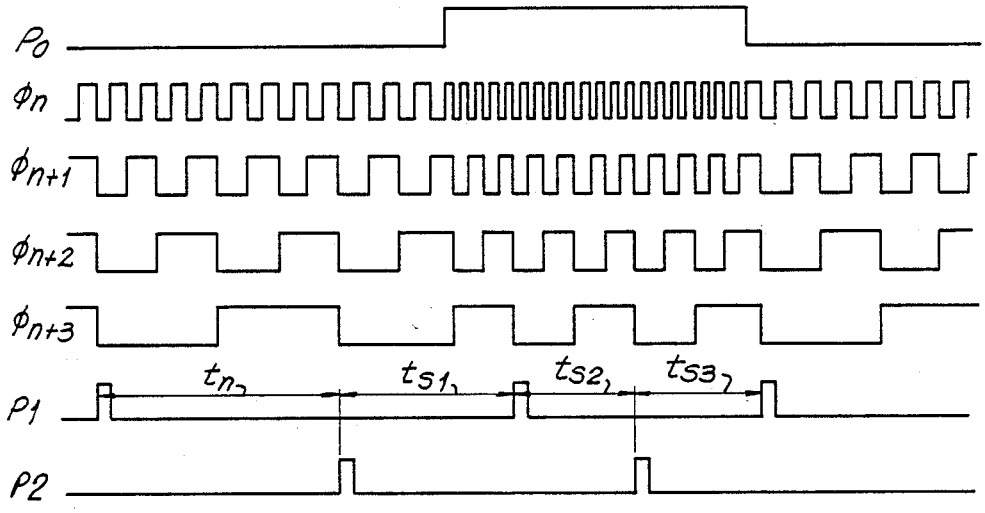
FIG. 13 is a timing chart of the signals produced by the compensating circuit for varying the speed of the step motor.

FIG. 13 illustrates the effect of control signal $P_0$ on driving pulses P1 and P2. More particularly, when control signal $P_0$ is at a high logic level, the frequency of oscillating signal $\phi_n$ is increased resulting in an increase in the number of trailing edges of signal $\phi_{n+3}$ within a given period of time. The number of driving pulses P1 and P2 during the period when control signal $P_0$ is at a high logic level increases. In particular, a gradual reduction in the time period between consecutive trailing edges of signal $\phi_{n+3}$ from a time interval $t_n$ to a time interval $t_{s3}$ to a time interval $t_{s2}$ to a time interval $t_{s3}$ results. The number of times rotor 5 rotates within a given period of time increases resulting in an advancement in the time displayed to compensate for an increase in load torque $T_r$ due to a decrease in temperature. It is to be understood that the invention is not limited to the foregoing methods for driving the step motor and that other methods in accordance with the invention can be used.

Figures 14, 15:
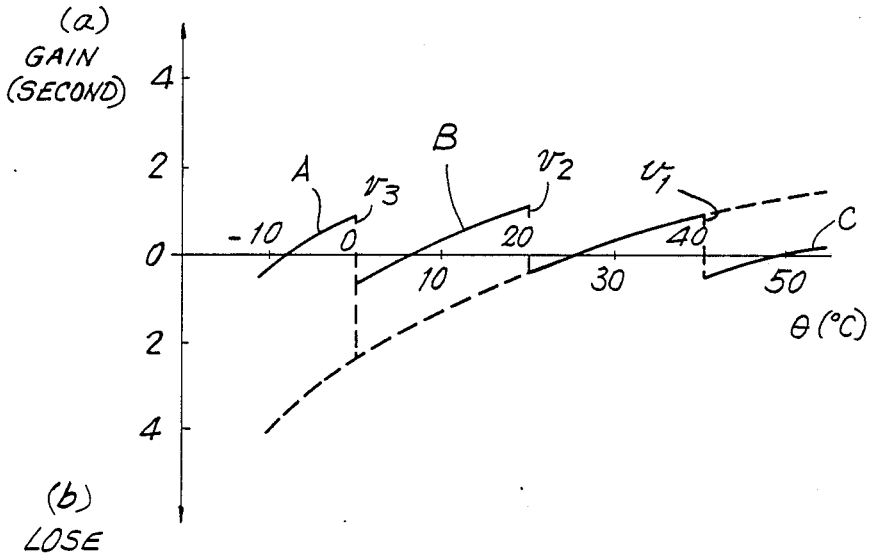
FIG. 14 is a plot of displayed time versus temperature.
FIG. 15 is a correction table.

FIG. 14 illustrates the effects of compensating circuit 400 in correcting discrepancies in the displayed time by second hand 16. FIG. 15 is a corresponding correction table. The broken curved lines of FIG. 14 corresponds to fluctuations in load torque $T_r$ due to variations in temperature resulting in changes in the viscosity of viscous fluid 17. The broken curved line is based on initially setting timepiece 300 when the ambient temperature is 25° C. The unbroken curved lines A, B, and C represent the discrepancies in displayed time. Assuming that the time is originally set when the ambient temperature is 25° C., a delay of approximately 4 seconds will occur at a temperature of −10° C. An advancement by second hand 16 of approximately 1.4 seconds will occur at a temperature of 50° C. Reference voltages $v_1$, $v_2$ and $v_3$ of detecting unit 110 are set to levels of 1.58 volts, 1.1 volts and 0.6 volts, respectively. Driving pulses P1 and P2 provide advancements of second hand 16 of 1.2 seconds, 1.6 seconds and 1.8 seconds as the inverse induced voltage decreases from reference voltage $v_1$ to $v_2$ to $v_3$ (i.e. $v_1 \rightarrow v_2 \rightarrow v_3$). When the inverse induced voltage increases from reference voltage $v_3$ to $v_2$ to $v_1$ (i.e. $v_3 \rightarrow v_2 \rightarrow v_3$), driving pulses P1 and P2 will provide corresponding delays in driving the step motor.

Reference voltages $v_1$, $v_2$ and $v_3$ can be set to any arbitrary value as determined by resistors 118, 119 and 120 based on the degree of compensation. When inverse induced voltages S1 and S2 exceed reference voltage levels $v_3$, $v_2$ and $v_1$ corresponding to temperatures of 0° C., 20° C. and 40° C., respectively, compensating circuit 400 adjusts the strength (i.e. energy) of driving pulses P1 and P2 to correct for time delays and advancements.

When the time of timepiece is 300 is initially set at 25° C., compensation circuit 400 ensures that any time discrepancy is not greater than one second when the ambient temperature ranges between −10° C. and +50° C. The accuracy of timepiece 300 is significantly improved by use of compensating circuitry 400 as compared to conventional electronic timepieces.

Figure 16:
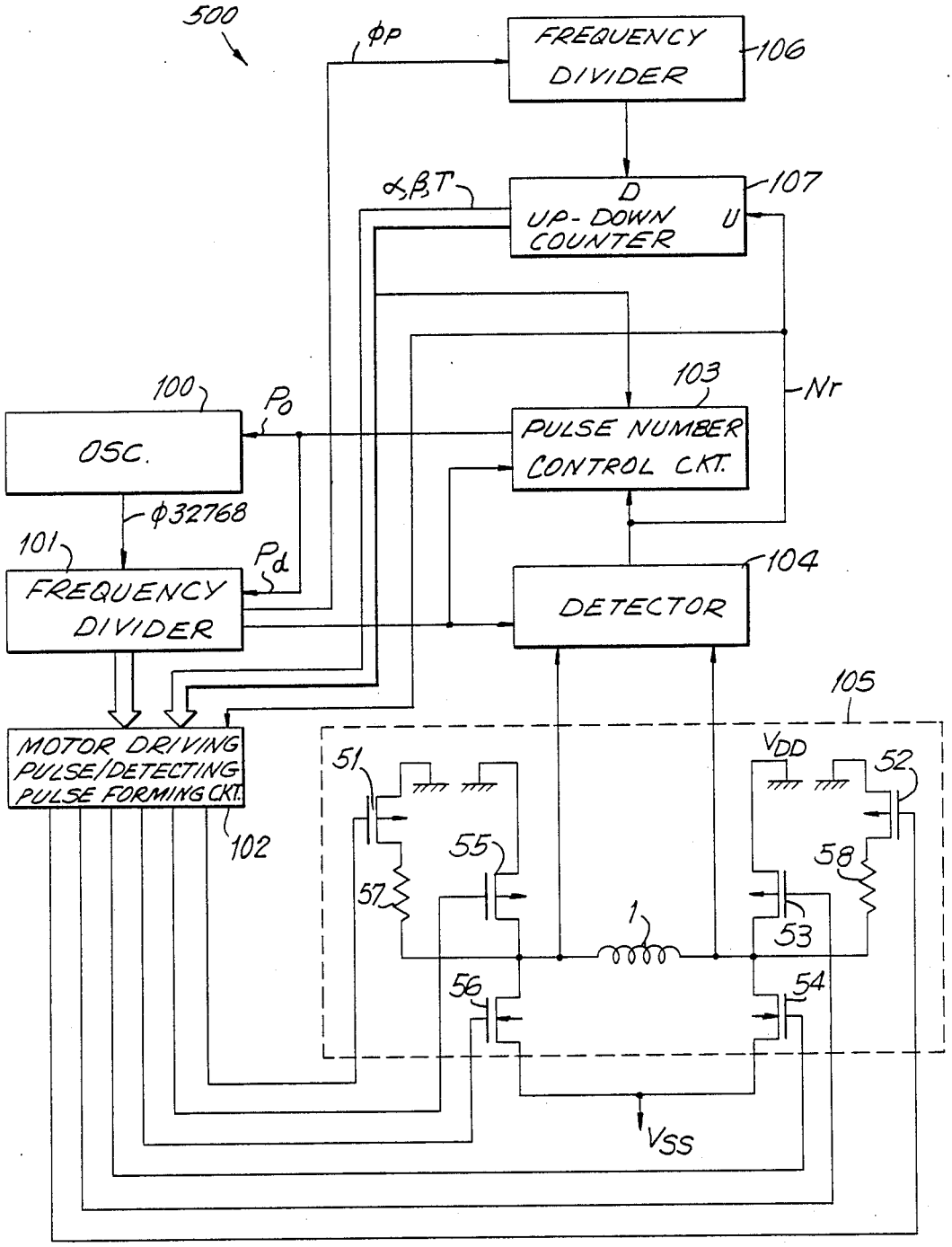
FIG. 16 is a schematic and block diagram of a compensating circuit in accordance with an alternative embodiment of the invention.

As shown in FIG. 16, a compensation circuit 500 in accordance with an alternative embodiment of the invention is illustrated. Those elements in FIG. 16 which are constructed and operate in the same manner as like elements of FIG. 1 are identified by like reference numerals. Compensating circuit 500 can be used with a low power consumption driving system of an analog electronic watch such as disclosed in Japanese Patent Laid-Open Nos. 75520/1979, 77162/1979 and 87977/1977.

Compensating circuit 500 includes a frequency dividing circuit 106 and a ⅛ up-and-down counter 107 which are well known in the art for use in low power consumption driving systems of conventional analog electronic watches. Counter 107 produces signals $\alpha$, $\beta$ and $\Gamma$ in response to clock signals $\phi_p$ produced by by frequency divider 101. Clock signals $\phi_p$ correspond to the frequency of driving pulses P1 and P2. Circuit 102 produces the optimum pulse width supplied to coil 1 of the step motor based on load torque $T_r$. More particularly, detecting circuit 104 produces a judgment signal $N_r$ representing whether the step motor is rotating which is supplied to counter 107 and circuit 102. Signals $\alpha$, $\beta$ and $\Gamma$ reflect the value of judgment signal $N_r$. Circuit 103 produces control signals $P_0$ and $P_d$ representing the degree of correction required in connection with the driving pulse widths associated with the step motor and judgment signals $N_r$. The pulse widths of driving pulses P1 and P2 vary based on load torque $T_r$ to compensate for fluctuations in load torque $T_r$. The reference voltages of detecting circuit 104 may be set at a level suitable for detecting the rotation and non-rotation of the step motor (e.g. a high logic level). Circuitry may be added for detecting an AC magnetic field, if desired. A high frequency magnetic field also may be added to detecting circuit 104 or by other techniques for changing the pulse width.

FIG. 17 graphically illustrates the relationship between torque T acting on viscous rotor 14 produced by the step motor and pulse width PW. Pulse width PW is substantially proportional to torque T for values less than $W_1$ (i.e. having a narrower pulse width). Pulse widths PW beyond pulse width $W_8$ (i.e. wider than pulse width $W_8$) correspond to a substantially saturated state of torque T.

As shown in FIG. 19, a correction table corresponding to FIG. 17 includes the values of signal $\alpha$, $\beta$ and $\Gamma$ of counter 107 corresponding to pulse widths $W_1$–$W_8$ and the associated correction quantities. More particularly, driving pulse width $W_1$ having a value of 1.95 seconds will result in counter 107 producing signals $\alpha$, $\beta$ and $\Gamma$ having low logic levels. When driving pulses P1 and P2 have a width $W_4$ of 2.69 msec, counter 107 produces high logic levels for $\alpha$ and $\beta$ and a low logic level for $\Gamma$. An increase in pulse width from $W_1$ to $W_2$ results in a time advancement of 1.2 seconds. An increase in driving pulses P1 and P2 from widths $W_2$ to $W_3$ or from $W_3$ to $W_4$ result in time advancements of 1.1 seconds. An increase in the pulse width of driving pulses P1 and P2 from $W_4$ to $W_5$ and from $W_5$ to $W_6$ results in time advancements of 1.0 second. By increasing the pulse width from $W_6$ to $W_7$ and from $W_7$ to $W_8$, time advancements of 0.9 and 0.8 seconds are obtained, respectively. In other words, inasmuch as torque T begins to approach saturation as the pulse width increases, the incremental delay in time as the temperature decreases begins to decrease. The incremental advancement in time provided by a longer pulse width also decreases. Conversely, as the temperature increases, the incremental advancement in time displayed by timepiece 300 increases. Accordingly, the incremental delay required to compensate for such advancement also increases. By increasing the pulse width, a greater corrective advancement in the displayed time is obtained. Conversely, by decreasing the pulse width, a greater corrective delay is produced.

FIG. 18 illustrates the corrective gain or corrected delay of second hand 16 produced by compensating circuit 500 at a temperature of Θ° C. The dashed lines represent the time delay of timepiece 300 prior to correction. The solid lines represent the corrective action taken in accordance with the invention.

Referring now to FIGS. 17, 18 and 19, when driving pulses P1 and P2 having pulse width $W_3$ (i.e. 2.44 msec.) timepiece 300 operates within a range of 10° C. through 25° C. At a temperature of 0° C. to 10° C., driving pulses P1 and P2 increase to width $W_4$ (i.e. 2.69 msec.). Simultaneously, control signals $P_0$ and $P_d$ are produced by pulse number control circuit 103 such that a corrective advancement of 1.1 seconds of second hand 16 results. When the temperature increases once again to beyond 10° C., the pulse width of driving pulses P1 and P2 changes to width $W_3$ (i.e. 2.44 msec). A corrective delay of 1.1 seconds results. The time displayed by timepiece 300 returns to its original uncorrected state. Discrepancies in the time displayed are substantially proportional to load torque $T_r$ based on the characteristics of the accumulating mechanism (i.e. hairspring 10). The characteristics of the step motor (i.e. actuator) illustrated in FIG. 17, however, are not substantially proportional to the widths of driving pulses P1 and P2. Consequently, the degree of correction varies between 1.2 seconds to 0.8 seconds.

As now can be readily appreciated, the discrepancy between the displayed time when originally set at 25° C. can be reduced to variations of no greater than one second. Pulse widths $W_7$ and $W_8$ are required when timepiece 300 includes a calendar mechanism. Time delays accompanying calendar feeding or the like included in timepiece 300 are corrected through use of compensating circuits 400 and 500.

Compensating circuits 400 and 500 correct discrepancies in the time displayed by timepiece 300 which are caused by variations in load torque $T_r$ by increasing or decreasing the strength (i.e. frequency, timing and pulse widths) of driving pulses P1 and P2 for driving the step motor. The correction is initiated once the magnitude of load torque $T_r$ is detected based on inverse induced voltages S1 and S2. The actual correction is reflected by the change in the number of driving pulses P1 and P2 and/or changes in pulse width of driving pulses P1 and P2. The invention is not limited to the particular method chosen of detecting inverse induced voltages S1 and S2 (for monitoring the flow of inverse induced current in coil 1), the timing of such corrections or the particular method and quantity of implementing such corrections.

The accumulating mechanism for storing energy is not limited to hairspring 10 and may include other storage means such as the magnetic coupling associated with the angular deviation of a pair of magnetic substances disposed adjacent to one another. The controlling mechanism also does not require the exclusive use of viscous fluid 17. For example, deviations in load torque provided by an electromagnetic brake which is not influenced by variations in temperature can utilize the invention. Fluctuations in load torque which impart fluctuations transferred to the actuator (e.g. step motor) resulting in discrepancies in the displayed time can be corrected in accordance with the invention. The embodiments of the invention discussed herein, which couple the driving force of the actuator temporarily stored in hairspring 10 through a wheel train to rotate the hands of timepiece 300, detect variations in load torque $T_r$ by monitoring the level of inverse induced voltage v. The invention can correct discrepancies between the displayed time due to variations in viscosity of viscous fluid 17 and of oil otherwise associated with the wheel train unit and due to discontinuous loads such as associated with calendar feeding or the like. Consequently, inaccuracies in the displayed time can be substantially minimized providing a highly accurate sweep hand movement for an electronic timepiece.

It will thus be seen that the objects set forth and those made apparent from the preceding description are efficiently attained and, since certain changes may be made in the above method and construction set forth without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention, which as a matter of language, might be said to fall therebetween.

What is claimed is:

1. A timepiece comprising:

means for producing a driving signal;

motor means for producing a mechanical driving force based on the driving signal;

storage means for storing energy associated with said mechanical driving force and for producing a driving torque based on said stored energy;

first control means for producing a load torque and for controlling the production of said driving torque at a relatively constant level based on said load torque;

indicator means for rotatingly indicating the time based on said driving torque; and compensating means for varying the driving signal based on the level of said load torque.

2. The timepiece of claim 1, wherein said compensating means includes means for increasing the strength of the driving signal as said load torque increases and for decreasing the strength of the driving signal as said load torque decreases.

3. The timepiece of claim 1, wherein said motor means includes coil means for providing an alternating magnetic field, said coil means characterized by an inversed induced current flowing therethrough and corresponding to the level of said load torque.

4. The timepiece of claim 3, wherein said compensating means includes detecting means for detecting the level of an inversed induced voltage corresponding to the inversed induced current and second control means for controlling the strength of said driving signal based on the level of the inversed induced voltage detected.

5. The timepiece of claim 4, wherein said second control means produces a first control signal for varying the frequency of said driving signal.

6. The timepiece of claim 4, wherein said second control means produces a control signal for varying the time duration of said driving signal.

7. The timepiece of claim 5, wherein said second control means also produces a second control signal for varying the time duration of said driving signal.

8. The timepiece of claim 4, wherein said detecting means includes selecting means for selecting among a plurality of voltage levels, means for comparing said inverse induced voltage to a reference level and third control means for controlling the selection by said selecting means of which of the plurality of voltage levels serves as the reference level.

9. The timepiece of claim 4, wherein detecting means produces a detected signal representing the level of the inversed induced voltage detected and wherein said second control means includes decoding means for decoding the detected signal and for producing a correction signal, memory means for storing the correction signal and pulse forming means for producing control signals.

10. The timepiece of claim 9, wherein said means for producing a driving signal is operable for varying the frequency and timing of the driving signal in response to the control signals of said pulse forming means.

11. The timepiece of claim 1, wherein said means for producing a driving signal includes oscillating means for producing an oscillating signal, frequency divider means for counting the frequency of the oscillating signal and for producing an additional oscillating signal based on the frequency of the oscillating signal counted, and motor driving means for producing the driving signal based on the additional oscillating signal.

12. The timepiece of claim 10, wherein said means for producing a driving signal includes oscillating means for producing an oscillating signal and frequency divider means for counting the frequency of the oscillating signal and for producing an additional oscillating signal based on the frequency of the oscillating signal counted, and motor driving means for producing the driving signal based on the additional oscillating signal.

13. The timepiece of claim 12, wherein said frequency divider means includes a plurality of dividers, at least one of which is set or reset based on the control signals produced by the pulse forming means.

14. The timepiece of claim 12, wherein said oscillating means includes means for varying the frequency of said oscillating signal based on the control signals produced by the pulse forming means.

15. The timepiece of claim 13, wherein said oscillating means includes means for varying the frequency of said oscillating signal based on the control signals produced by the pulse forming means.

16. The timepiece of claim 12, wherein said frequency divider means also produces clock signals supplied to said detector means and said second control means and wherein the timing of said detected signal, correction signal and control signals is based on said clock signals.

17. The timepiece of claim 6, wherein said detector means also produces a judgement signal representing the state of said mechanical driving force and wherein said second control means includes frequency divider means for producing an output signal having a frequency which corresponds to the present frequency of said driving signal and counting means for producing pulse width control signals in response to said judgement signal and said output signal, said means for producing a driving signal responsive to said pulse width signals for varying the time duration of said driving signal.

18. The timepiece of claim 13, wherein said detector means also produces a judgement signal representing the state of said mechanical driving force and wherein said second control means includes frequency divider means for producing an output signal having a frequency which corresponds to the present frequency of said driving signal and counting means for producing pulse width control signals in response to said judgement signal and said output signal, said motor driving means responsive to said pulse width control signals for varying the time duration of said driving signal.

19. The timepiece of claim 14, wherein said detector means also produces a judgement signal representing the state of said mechanical driving force and wherein said second control means includes frequency divider means for producing an output signal having a frequency which corresponds to the present frequency of said driving signal and counting means for producing pulse width control signals in response to said judgement signal and said output signal, said motor driving means responsive to said pulse width control signals for varying the duration of said driving signal.

20. The timepiece of claim 16, wherein said detector means also produces a judgement signal representing the state of said mechanical driving force and wherein said second control means includes frequency divider means for producing an output signal having a frequency which corresponds to the present frequency of said driving signal and counting means for producing pulse width control signals in response to said judgement signal and said output signal, said means for producing a driving signal responsive to said pulse width control signals for varying the duration of said driving signal.

21. The timepiece of claim 1, wherein said first control means includes a rotor immersed in a viscous fluid.

22. The timepiece of claim 1, wherein said storage means includes a hairspring.

23. The timepiece of claim 22, wherein said first control means includes a rotor immersed in a viscous fluid.

24. The timepiece of claim 2, wherein said storage means includes a hairspring of said first control means includes a rotor immersed in a viscous fluid.

25. The timepiece of claim 1, wherein said compensating means includes detecting means for detecting variations in the load torque.

26. A method for displaying the correct time of day comprising:

generating a driving signal;

producing a mechanical driving force based on the driving signal;

storing the energy associated with the mechanical driving force and producing a driving torque based on the stored energy;

supplying the driving torque to a load which produces a load torque;

controlling the production of the driving torque at a relatively constant level based on the load torque;

rotatingly indicating the time based on the driving torque; and varying the driving signal based on the level of the load torque to compensate for variations in the load torque.

27. The method of claim 26, further including increasing the strength of the driving signal as the load torque decreases and decreasing the strength of the driving signal as the load torque decreases.

28. The method of claim 27, further including detecting the inverse induced current flowing through a step motor of a timepiece wherein said driving signal is varied based on the level of the inverse induced current detected.

29. The method of claim 28, wherein the frequency of the driving signal is varied based on the level of the inverse induced current detected.

30. The method of claim 28, wherein the time duration of the driving signal is varied based on the level of the inverse induced current detected.

31. The method of claim 29, wherein the time duration of the driving signal is varied based on the level of the inverse induced current detected.

* * * * *